United States Patent [19]

Hayashi

[11] Patent Number: 4,535,942

[45] Date of Patent: Aug. 20, 1985

[54] APPARATUS FOR CONTAINING EASILY SOLIDIFYING POWDER AND PARTICLES

[75] Inventor: Takeshi Hayashi, Naruto, Japan

[73] Assignee: Kyoeizoki Co., Ltd., Naruto, Japan

[21] Appl. No.: 443,652

[22] Filed: Nov. 22, 1982

[30] Foreign Application Priority Data

Dec. 2, 1981 [JP] Japan ..... 56-194875
Dec. 3, 1981 [JP] Japan ..... 56-195236

[51] Int. Cl.[3] ..... B02C 19/12

[52] U.S. Cl. ..... 241/36; 241/138; 241/DIG. 17

[58] Field of Search ..... 241/DIG. 17, 101.2, 241/101.4, 101.5, 101.7, 189 R, 186 A, 36, 35, 154, 152 R, 138

[56] References Cited

U.S. PATENT DOCUMENTS 2,114,557 4/1938 Davis ..... 241/DIG. 17 X
2,609,152 9/1952 Brough ..... 241/189 R X
2,791,887 5/1957 Hennig ..... 241/DIG. 17 X
3,181,800 5/1965 Noren et al. ..... 241/36 X
4,151,794 5/1979 Burkett ..... 241/154 X
4,168,805 9/1979 Taylor ..... 241/DIG. 17 X
4,179,074 12/1979 Flavel ..... 241/36 X
4,333,612 6/1982 Hayashi .

FOREIGN PATENT DOCUMENTS 49673 4/1980 Japan .
95074 7/1980 Japan .
3863 1/1981 Japan .
34545 8/1981 Japan .

*Primary Examiner*—Mark Rosenbaum
*Attorney, Agent, or Firm*—Wenderoth, Lind & Ponack

[57] ABSTRACT

An apparatus for containing easily solidifying powder and particles has a casing having a capacity for containing a required amount of easily solidifying powder and particles and having in its bottom portion a discharge opening for discharging powder and particles therethrough, a discharge conveyor placed at the bottom of the casing and extending horizontally or substantially horizontally, and a crusher disposed above the discharge conveyor for scraping powder and particles from the bottom of the mass of powder and particles above the discharge conveyor.

8 Claims, 20 Drawing Figures

APPARATUS FOR CONTAINING EASILY SOLIDIFYING POWDER AND PARTICLES

BACKGROUND OF THE INVENTION

The present invention relates to a containing apparatus for temporarily containing easily solidifying powder and particles which tend to bridge when contained in a container such as crushed ice, lime and the like, and especially relates to a containing apparatus for crushing solidified powder and particles in the containing apparatus and taking out the same.

PRIOR ART

The inventor has developed a containing apparatus shown in FIGS. 1 and 2 of the appended drawings for containing crushed ice which tends to bridge when contained therein.

In this containing apparatus, the casing 1 has a shape that its horizontal section becomes gradually larger in the downward direction, and at the bottom of the casing 1 there are provided a plurality of discharge conveyors 2. When the discharge conveyors are operated, crushed ice 3 in the casing 1 is scraped off the bottom of the mass of material and discharged to the outside, so that the crushed ice in the container 1 will be brought down to the bottom without adhering to the inner wall surface of the casing 1 and successively discharged.

However, in a containing apparatus of such a kind, since the casing 1 as a whole tapers inwardly in the upward direction, the horizontal dimension of the cross-section of the casing 1 becomes gradually smaller in the upward direction. Therefore, disadvantageously, it is hard to obtain a casing having sufficient capacity relative to its height.

BRIEF SUMMARY OF THE INVENTION

An object of the present invention is to provide an apparatus for containing easily solidifying powder and particles in which a sufficient amount of powder and particles can be contained considering the area of the horizontal cross-section thereof.

Another important object of the present invention is to provide an apparatus for containing easily solidifying powder and particles in which solidified powder and particles in a casing can be smoothly taken out.

A further important object of the present invention is to provide an apparatus for containing easily solidifying powder and particles in which it is unnecessary to provide discharge conveyors over the whole bottom of the casing, the discharge conveyors being constructed simply and inexpensivly, whereby the apparatus as a whole can be manufactured at a low cost.

A further important object of the present invention is to provide an apparatus for containing easily solidifying powder and particles in which since the powder and particles are moved toward a crusher by their own weight, it is unnecessary to push the powder and particles against the crusher and the mechanism therefor can be simplified.

The above and further objects and novel features of the invention will more fully appear from the following detailed description when the same is read in connection with the accompanying drawings. It is to be expressly understood, however, that the drawings are for the purpose of illustration only and is not intended as a definition of the limits of the invention.

DETAILED DESCRIPTION OF THE INVENTION

Now, examples of the present invention will described below with reference to the appended drawings, in which.

Figure 1:
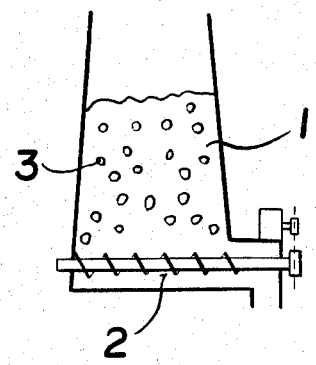
FIG. 1 (PRIOR ART)
FIGS. 1 and 2 are sectional views of a conventional containing apparatus for containing crushed ice.
Figure 2:
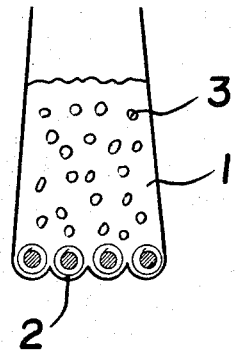
FIG. 2 (PRIOR ART)
Figure 3:
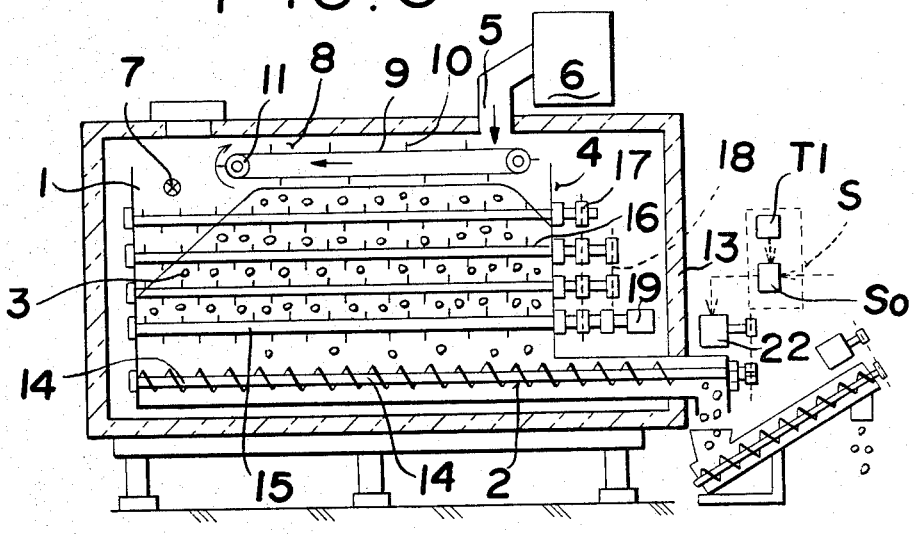
FIGS. 3 and 4 are a longitudinal sectional view and a cross sectional view of an example of a containing apparatus according to the invention for containing crushed ice.
Figure 4:
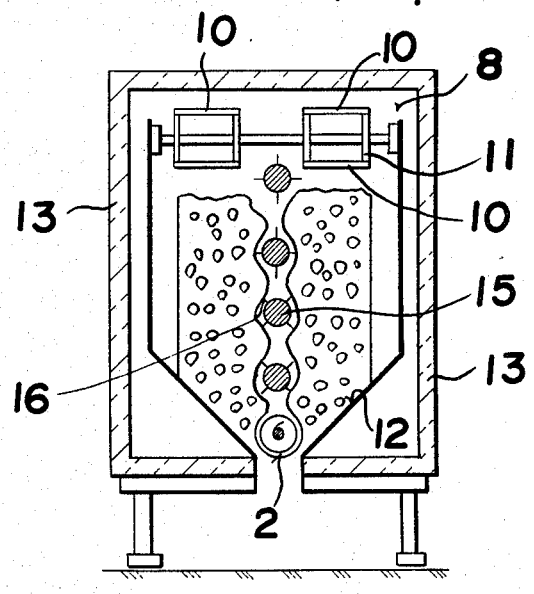

FIGS. 3 and 4 shows an apparatus for containing crushed ice which is typical of easily solidifying powder and particles. Other powder and particles than crushed ice can also be contained by and discharged out of the same containing apparatus. The containing apparatus comprises a casing 1 for containing crushed ice or other powder and particles therein, a discharge conveyor 2 provided at the bottom of the casing 1, and a crusher 4 for crushing crushed ice extending upwardly from just above the discharge conveyor 2 in a vertical plane.

The casing 1 has a narrow rectangular horizontal cross-section and has in a part of its ceiling an opening 5 for feeding crushed ice from an ice making machine 6.

The operation of the ice making machine 6 is controlled by a level indicator 7 provided at the upper portion of the casing 1, and the ice making machine 6 is operated when the crushed ice in the casing 1 is below a predetermined level so as to maintain a given amount of crushed ice in the casing 1.

It is preferable to provide a levelling means 8 at the upper portion of the casing 1. In the levelling means 8, levelling blades 10 are fixed at equal intervals on four chains 9. The four chains 9 are engaged around two sprockets horizontally positioned at either end in FIG. 3, so that the chains are driven by the sprockets to level the body of crushed ice 3 in the casing 1.

The bottom surface 12 of the casing 1 is inclined to form a falling gradient toward the central discharge conveyor 2. The crushed ice the middle portion of which has been vertically scraped slides on the bottom surface 12 of the casing and is pressed by the crusher 4.

The angle of inclination of the bottom surface 12, that is, the angle formed between the bottom surface 12 and a horizontal plane is usually more than 10 degrees, preferably 15 to 60 degrees and most 20 to 40 degrees and the bottom surface 12 is formed, for example, of a stainless plate with a smooth surface so that crushed ice smoothly slides thereon.

The outside of the casing 1 is surrounded by a heat insulating wall 13.

The discharge conveyor 2 is a screw conveyor the rotatable shaft 14 of which extends parallel with the longitudinal axis of the casing 1 from one end to the other end of the casing 1. And on the surface of the shaft 14 are mounted feeding claws in a screw thread pattern.

One end of the shaft 14 of the discharge conveyor 2 is connected to an electric motor 22 which is a drive means. When the electric motor is rotated in the normal direction, crushed ice is discharged out of the casing by the discharge conveyor 12. The drive means is provided with a contrarotating starter S which when the started is activated, contrarotates the shaft 14 for a predetermined time and then rotates the same in the normal direction.

When the drive means is the electric motor 22, the contrarotating starter S comprises a timer T1 and a changeover switch So. The timer T1 controls the time during which the shaft 14 is contrarotated at the start of its actuation. An example of a circuit for the timer T1 and the switch So is shown in FIG. 5.

Figure 5:
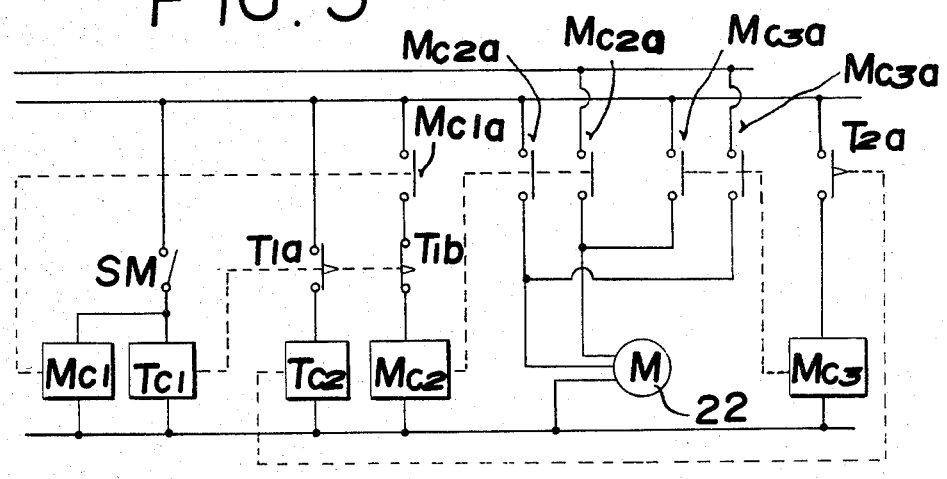
FIG. 5 is a circuit diagram of an example of a contra-rotating starter.

In FIG. 5, an electromagnetic coil Tc1 of the timer T1 is connected through a main switch SM to an electric power source, and b contact point T1*b* of the timer T1 is connected in series with an electromagnetic coil MC2 of a relay for contrarotating the electric motor 22.

Further, a contact T1*a* is connected in series with an electromagnetic coil Tc2 of a timer T2 for delaying the actuating time during which the shaft 14 is ordinarily rotated. To the b contact point T1*b* of the timer T1, a contact Mc1*a* of a relay directly controlled by the main switch SM is connected in series. By this a contact MC1*a*, the operation of the electric motor 22 is turned off when the main switch SM is off.

The operation of this circuit is as follows. Firstly the main switch SM is turned on thus to close the contact MC1*a* of the relay, and an electric current is sent through the b contact T1*b* to the electromagnetic coil MC2, the a contact MC2*a* being closed whereby the motor 22 is contrarotated. When the timer T1 indicates the passage of a predetermined time, the b contact T1*b* of the timer T1 is opened and the a contact T1*a* of the timer T2 is closed, and the timer T2 starts to count. In this condition, since both the a contact T2*a* of the timer T2 and the b contact T1*b* of the timer T are closed, an electric current is not sent to the electric motor 22. This state is continued till the electric motor is completely or substantially stopped. When the timer T2 indicates the passage the predetermined time, a contact T2*a* of the timer T2 is closed, the electric motor 22 starts to normally rotate, and in this condition, the discharge conveyor 2 is operated to discharge crushed ice. When the main switch SM is turned off so as to stop discharging crushed ice, electricity does not pass the electromagnetic coil TC2 of the timer T2 and no electric current is sent to the electric motor 22.

Simultaneously with this, b contact T1*b* of the timer T1 is closed, but since the a contact MC1*a* of the relay connected in series to the b contact T1*b* is opened, the electric motor 22 is not operated.

In the crusher 4, a number of claws are fixed on the shaft 15 of the crusher 4. A plural number of shafts 15 of the crusher 4 are horizontally arranged in parallel just above the discharge conveyor 2.

Figure 6:
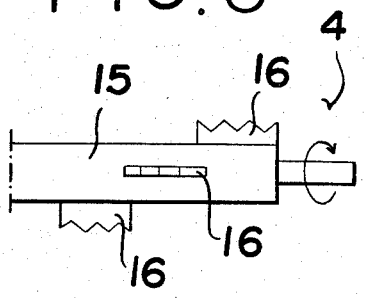
FIGS. 6 to 8 are a front and a side views of a part of a shaft of a crusher.
Figure 7:
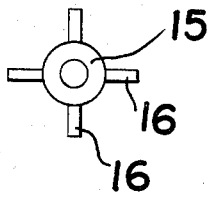
Figure 8:
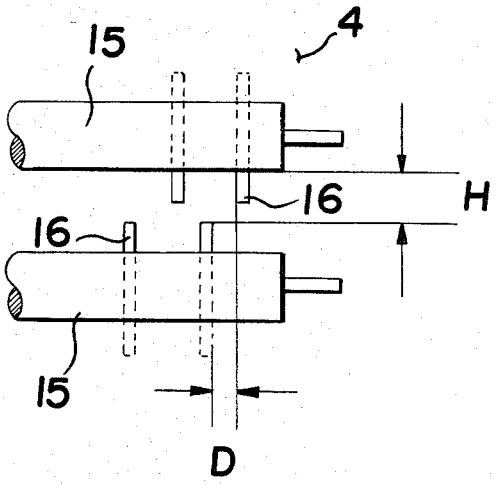

Examples of the claws 16 of the crusher 4 are shown in FIGS. 6 to 8. The claws 16 shown in FIGS. 6 and 7 are relatively large in width and elongated in the longitudinal direction of the shaft 15 of the crusher 4. The claws 16 adjacent to each other in the direction of the rotation are somewhat overlapped. This crusher 4 is characterized in that when rotated, it can scrape or claw down crushed ice uniformly through the whole length of the shaft 15 of the crusher 4.

The claws 16 in FIG. 8 are pins which are fixed around the surface of the shaft 15 in accordance with the dimensions of the crushed ice. The distances D and H between the pins are decided normally below 100 mm when crushed ice is to be discharged.

In FIG. 3, on one end of each of the shafts 15 of the crusher 4, a sprocket wheel 17 is fixed. The sprocket wheel 17 is connected through a chain 18 to a gear motor 19. All the shafts 15 of the crusher 4 are rotated by the gear motor 19, whereby crushed ice is scraped or clawed down from the middle portion of the casing 1.

The operation of the gear motor 19 of the crusher 4 is controlled by a control member 20 and a load detector of the discharge conveyor 2.

Figure 9:
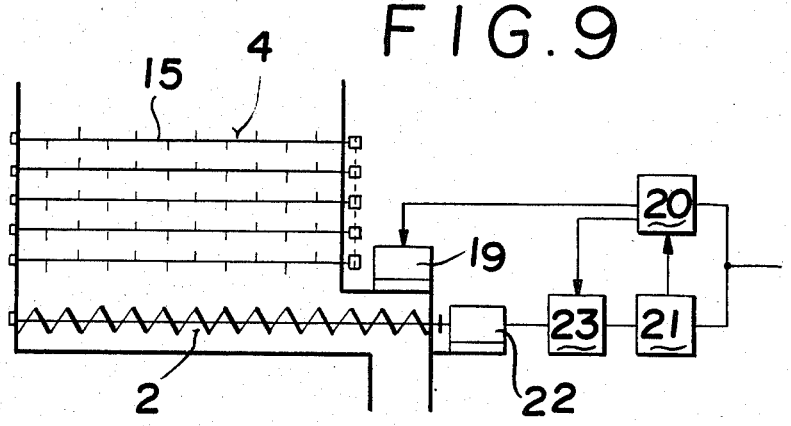
FIGS. 9 to 11 are schematic sectional views showing the connection of a load detector and a control member.

One example of the control member and the load detector 21 is shown in FIG. 9. In this figure, the load detector 21 of the discharge conveyor 2 is an electric current detector which detects the operating electric current of the electric motor 22 for driving the discharge conveyor 2. The control member 20 is controlled by the output of the electric current detector.

For the electric current detector and the control member 20, meter relays can be used, for example.

The electric current detector 21 generates signals in correspondence with the load electric current, normally the output voltage in proportion to the electric current.

According to the output signals, the control member 20 is turned on when the load of the motor is below the predetermined value, that is, when the discharge conveyor for the crushed ice races or discharges only a small amount of crushed ice, whereby the motor 19 is operated to operate the crusher 4.

When the crusher 4 is operated and crushed ice is scraped or clawed down onto the discharge conveyor 2, the discharge conveyor transfers a large amount of crushed ice, so that the operating electric current of the electric motor 22 increases. This is detected by the electric current detector and the control member 20 is turned off to stop the operation of the crusher 4.

When the control member 20 is in the "on" state, it may be automatically turned off after 0.5 to 2 seconds by a timer. In this case, the crusher 4 does not remove an excessive amount of crushed ice and the overloading of the discharge conveyor due to a delay in detecting an overload can be prevented. The control member 20 has a delay or integrating circuit and it is turned on after a predetermined time and below a set point of electric current.

Figure 10:
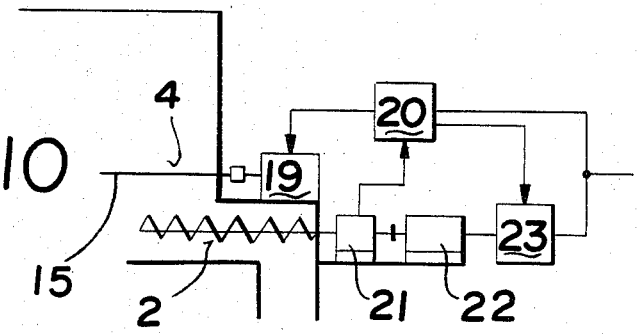

In FIG. 10, the load detector 21 is a torque detector which is fixed on the output shaft of the electric motor 22 for driving the discharge conveyor 2 and directly detects the rotation torque of the motor applied to the discharge conveyor 2. The output signals of the load detector 21 are transferred to the control member 20 and according to the output signals of the load detector 21, the control member 20 is turned on when the driving torque of the electric motor 22 is below a predetermined value and turned off when it is above the value.

The control member 20 is connected to a timer 23 which causes the discharge conveyor 2 operate for a predetermined time after the operation of the crusher 4 stops.

With this construction, if a signal is supplied indicating that the electric motor 22 should be turned off after the operation of the crusher 4 stops, the discharge conveyor 2 is nevertheless operated for a predetermined time and it stops operating after completely or at least partially discharging crushed ice clawed down by the crusher. Consequently, little crushed ice is left in the discharge conveyor 2 when it is to be started up again, and advantageously it can be more smoothly started.

Figure 11:
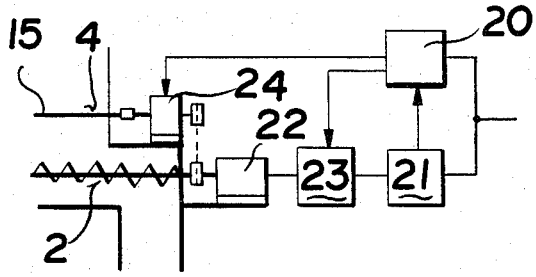

In FIG. 11, the electric motor 22 for driving the discharge conveyor 2 is also used as the motor for driving the crusher 4. The shaft 15 is connected through a clutch 24 to the electric motor 22 for driving the discharge conveyor 2. The engaging of the clutch 24 is controlled by the control member 20. The control member 20 is controlled by the input signals from the load detector 21.

The operation of the crusher 4 is as follows. When the load torque of the discharge conveyor 2 falls below the predetermined value, it is detected by the load detector 21 and according to the output signals of the load detector 21 the control member 20 engages the clutch 24 to operate the crusher 4.

When the crusher 4 has clawed down crushed ice onto the discharge conveyor 2 and the discharge conveyor 2 reaches the state of discharging a predetermined amount of crushed ice, the control member disengages the clutch 24 to stop the operation of the crusher 4, and by repeating this, crushed ice can be taken out of casing 1.

Figure 12:
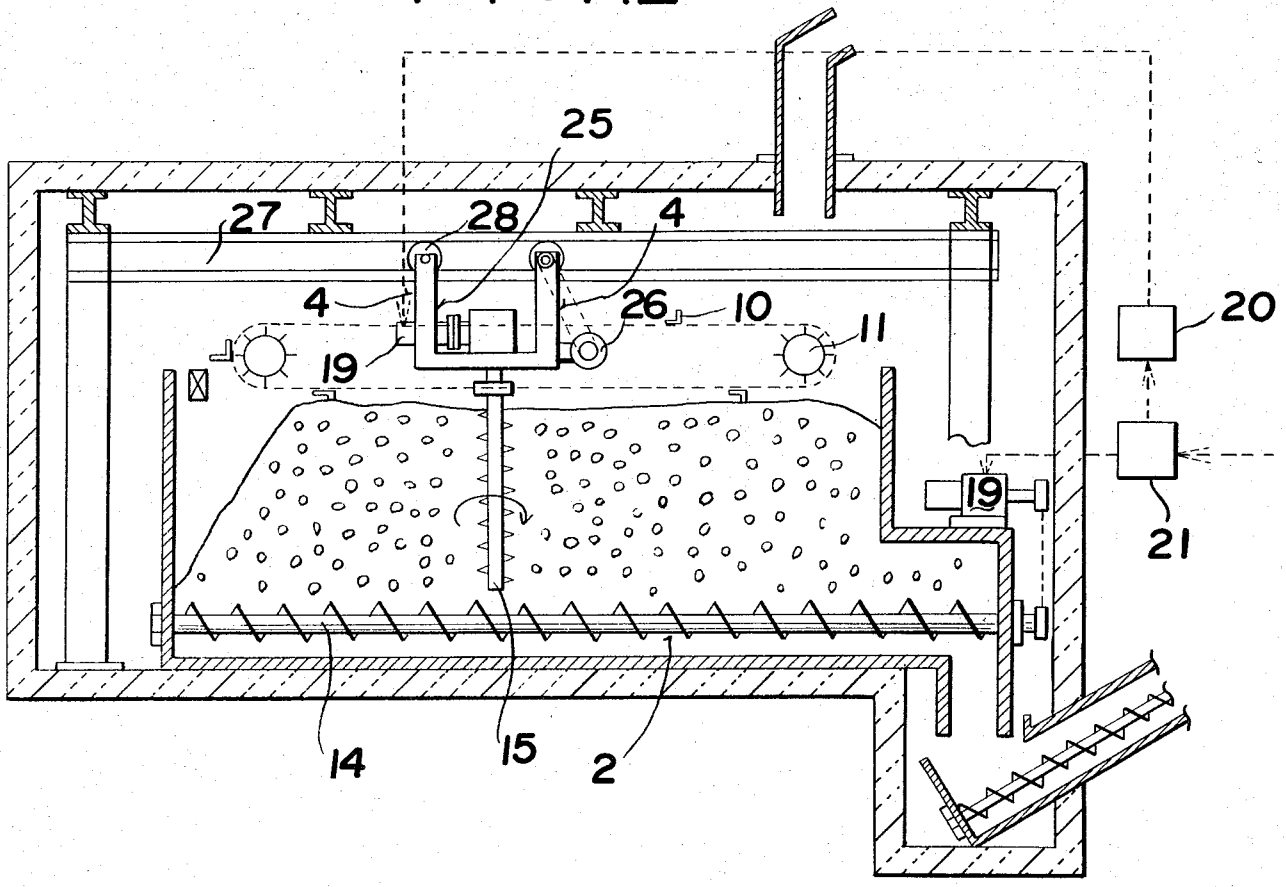
FIGS. 12 to 14 are longitudinal and transverse sectional views of a containing apparatus provided with a crusher movable in the horizontal direction and a front view of the crusher.
Figure 13:
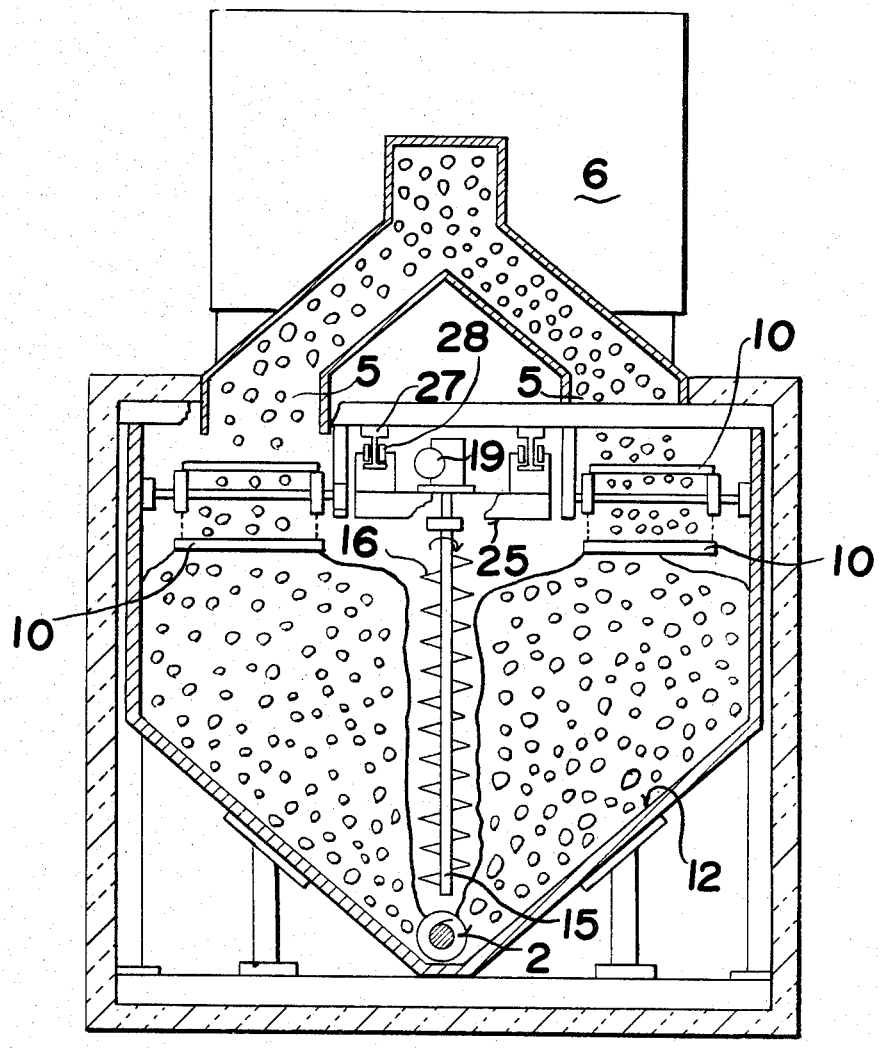
Figure 14:
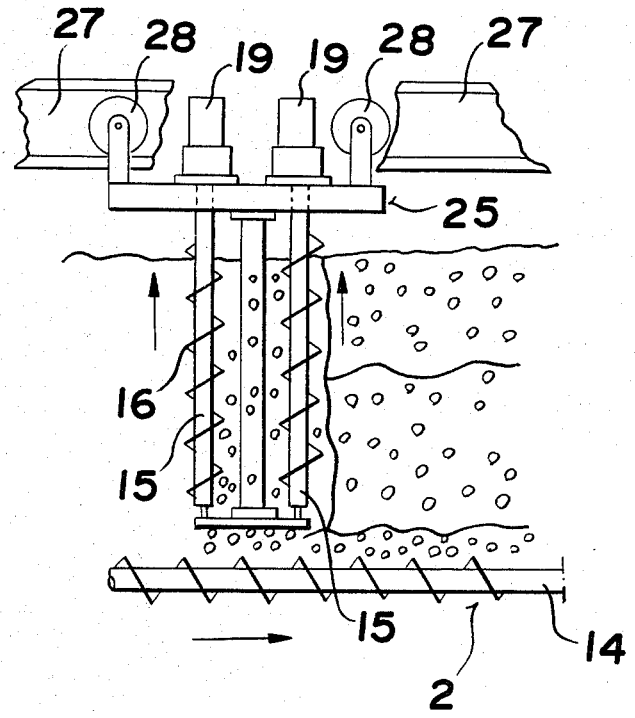
Figure 15:
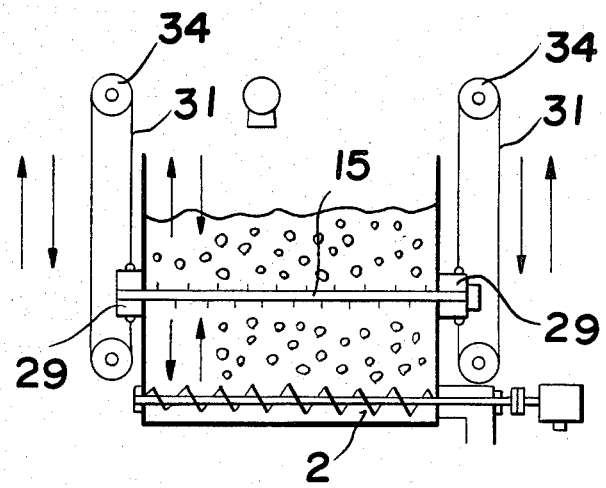
FIGS. 15 to 19 are a sectional and a perspective views of a containing apparatus provided a vertically movable crusher.
Figure 16:
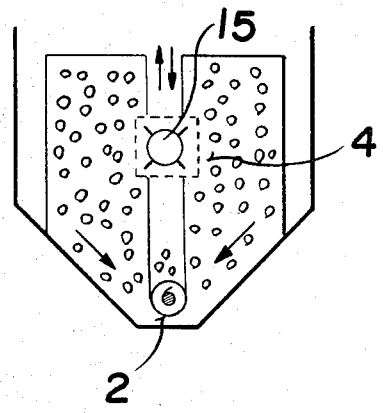
Figure 17:
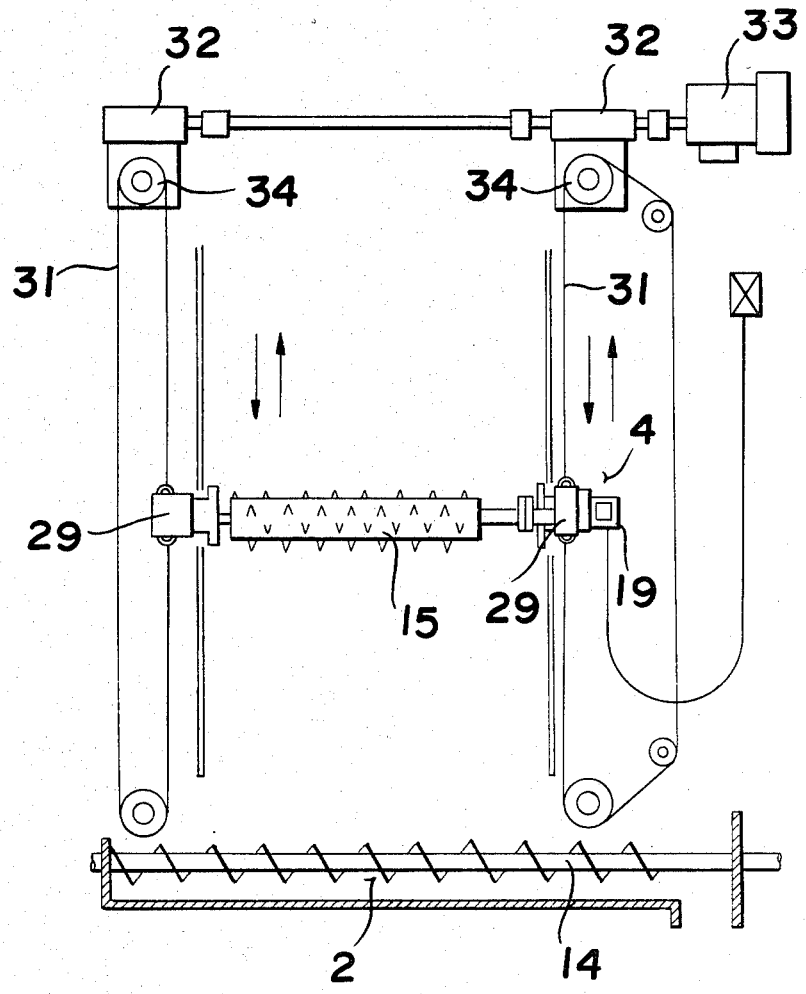
Figure 18:
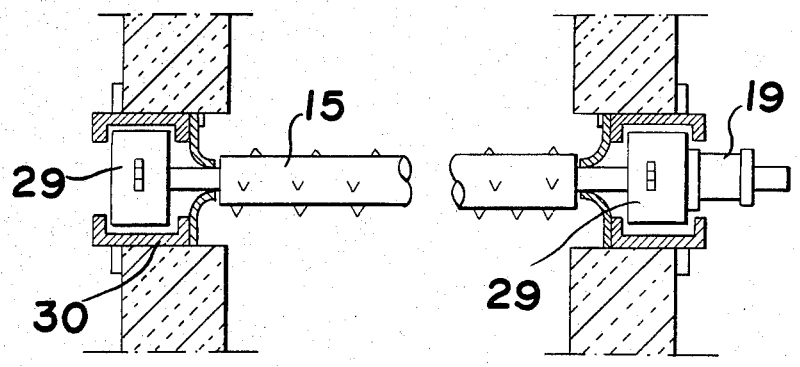
Figure 19:
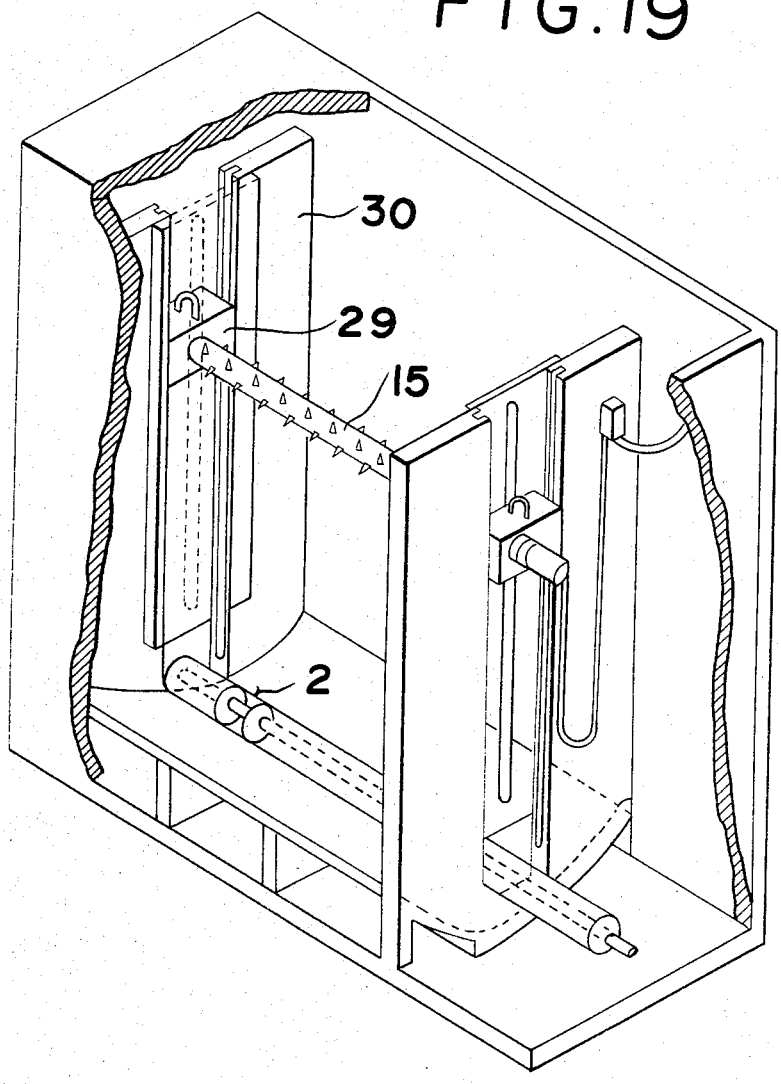

The shaft 15 of the crusher 4 shown in FIGS. 12 to 14 is located in the vertical direction and it can be displaced horizontally in line with the discharge conveyor 2 thus clawing crushed ice above the discharge conveyor 2 to cause it to fall downwardly in a vertical plane.

The crusher 4 is provided with a movable base 25, a gear motor 19 on the base for driving the shaft 15 and a driving motor 26 for moving the movable base 25, and the operation of the gear motor 19 for driving the shaft 15 is controlled by the control member 20.

The movable base 25 moves along a rail 27 fixed in the upper portion of the casing parallel with the discharge conveyor 2. The movement of the movable base 25 is by means of wheels 28 driven by the driving motor 26.

An electric current is sent to the running motor 26 and to the gear motor 19, and the shaft 15 of the crusher 4 is rotated and moved for clawing down crushed ice.

However, the movable motor 26 may be turned on or off in response to the detected driving torque of the shaft 15. In this case, similarly to the motor of the discharge conveyor, the electric current of the gear motor 19 for driving the shaft 15 is detected, for example, by a meter relay, and the driving motor 26 is operated when the torque of the gear motor 19 is below a predetermined value and stopped when it is above the value.

In the crusher 4 shown in FIG. 14, two vertical shafts 15 are arranged in parallel and on each of which claws 16 are fixed so that during the rotation of the shafts 15 of the crusher 4 the claws urge crushed ice upwardly.

According to this system, crushed ice scratched is not pressed toward the lower end portion of the shafts, and crushed ice is successively clawed by the claws 16 fixed on the shafts 15 upwardly and then falls downwardly.

In FIGS. 15 to 19, the shaft 15 of the crusher 4 is horizontally oriented and is movable in the vertical direction.

The shaft 15 of the crusher 15 is carried at both of its ends in bearings 29 so that the shaft 15 can be moved upwardly and downwardly in parallel in a vertical plane including the discharge conveyor 2. The bearings 29 are mounted on endless drive members 31 e.g. chains or wires, so that they can move along fixed vertical guide rails 30. The drive members 31 extend around on winch drums 34 which are connected through reduction gearings 32 to motor. The drive members 31 are driven by the winch drums whereby the bearings 29 are moved upwardly and downwardly.

On one of the bearings 29 is mounted the gear motor 19 for driving the shaft 15 of the crusher 4.

The gear motor 19 for driving the shaft 15 of the crusher 4 is operated at the same time as the motor 33 for vertically moving the shaft 15 of the crusher 4 only when the torque for driving the shaft 15 of the crusher 4 is below the predetermined value, similarly to the case of the above-described crusher 4 of FIGS. 12–14 in which the shaft 15 is horizontally moved.

In the crushers shown in FIGS. 12 to 19, when the horizontally or vertically, movable shaft 15 is rotated without displacing the same, the claws 16 on the shaft 15 do not claw down crushed ice and the shaft 15 is easily rotated. Therefore, it is preferable that the shaft 15 of the crusher 4 be rotated simultaneously with the operation of the discharge conveyor 2, the motor 33 or the driving motor 26 being operated when the rotation torque of the discharge conveyor 2 is below a set value, and after a predetermined time, the operation of the motor 33 or the running motor 26 is stopped automatically by a timer or when the torque of the discharge conveyor 2 is detected as being above the set value.

As described, when the operation of the crusher 4 is controlled by the timer, the crusher 4 is prevented from being operated for too long a time and thus from excessively breaking crushed ice into pieces. Further, in such a crusher 4, an excessive amount of crushed ice is not put on the discharge conveyor 2 and thus the discharge conveyor 2 is prevented from being overloaded. The "off" state of the crusher 4 can be controlled in response to the torque of the discharge conveyor 2. According to this system, however, the increase in the torque of the discharge conveyor 2 may be delayed, and even if a large amount of crushed ice is clawed down by the crusher, the driving torque of the discharge conveyor 2 does not rise immediately, so that disadvantageously the crusher 4 is operated for an excessively long time. Therefore, in the most preferable example, the torque is detected and the crusher 4 is actuated when the torque is below a set value, the operation of the crusher 4 being automatically stopped by a timer e.g. after 0.5 to 2 seconds.

Figure 20:
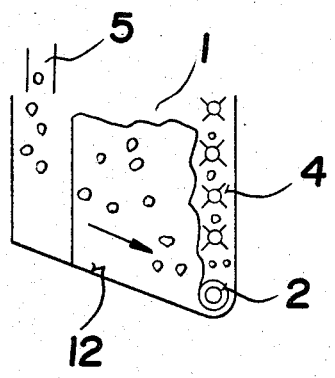
FIG. 20 is a diagrammatic sectional view of a container provided on one side thereof with a discharge conveyor.

In the containing apparatus shown in FIG. 20, the discharge conveyor 2 is provided at one side of the casing 1. The bottom surface 12 is inclined toward the discharge conveyor 2.

In the foregoing description, the powder and particles to be contained are crushed ice. However, since crushed ice especially easily solidifies in comparison with other powder and particles, a containing apparatus capable of discharging crushed ice can be used for other powder and particles.

EFFECTS

In an apparatus for containing easily solidifying powder and particles according to the present invention, powder and particles in the casing are not allowed to fall downwardly solely under the effect of gravity for being taken out of the bottom. Consequently, the casing need not be inwardly tapered in the upward direction, unlike a casing of a conventional containing apparatus. Thus, if the casing is tall, the horizontal section of the upper portion of the casing can be large-sized and a large amount of powder and particles can be contained for a given area of the bottom face of the casing.

Further, according to the present invention, powder and particles in the casing are clawed down by a crusher and then discharged out by a discharge conveyor. Therefore, powder and particles solidified in the casing can be easily taken out.

Further, according to the present invention, powder and particles are caused by the crusher to be dropped onto the discharge convyor, and unlike a conventional casing it is not necessary to provide discharge conveyors all over the bottom face of the casing. Therefor, only a small number of discharge conveyor(s) is provided and the construction of the discharge conveyor section can be simplified. As a result, the apparatus as a whole can be manufactured at a remarkably low cost.

Furthermore, according to the present invention, the bottom face of the casing is inclined downwardly toward the crusher, and powder and particles in the casing can be transferred to the crusher by their own weights to be clawed down by the crusher. Therefore, powder and particles are always pressed under a predetermined pressure by the crusher. As the result, the mechanism for pushing powder and particles against the crusher can be simplified, and the apparatus as a whole can be manufactured at a lower cost.

What is claimed is:

1. An apparatus for containing easily solidifying powder and particles, comprising:

a casing having a capacity for containing a desired amount of easily solidifying powder and particles and having a discharge opening in the bottom thereof for discharging powder and particles therethrough;

a discharge conveyor in the bottom of the casing and extending substantially horizontally from one end of the casing to the other along the middle of said casing for transferring powder and particles from one end to the other of the bottom of the casing, the discharge end of said discharge conveyor being communicated with said discharge opening;

a plurality of horizontally extending crusher shafts each extending substantially the full length of said casing and having a plurality of claws on the circumferential surface thereof and said shafts being positioned in a vertical plane directly above the discharge conveyor in the middle of said casing for engaging all of a vertically extending face of powder and particles extending substantially vertically from the discharge conveyor in a flat plane to a level corresponding to the level of the top of the body of powder and particles normally contained in the casing, and drive means connected to said shafts for rotating said shafts for clawing powder and particles from the face of the powder and particles to permit powder and particles to fall downward to said discharge conveyor;

said casing having side walls spaced outwardly from said crusher shafts a distance substantially greater than the diameter of said crusher shafts and having a bottom surface inclined downwardly to said discharge conveyor from the opposite sides of said casing, the angle of inclination being sufficient to cause the powder and particles to slide downwardly and inwardly toward said crusher shafts and said discharge conveyor due to their own weight, whereby powder and particles which fall down to said discharge conveyor are transferred by said discharge conveyor to the outside of said casing and the powder and particles left in said casing above said discharge conveyor slide on the bottom surface of said casing toward said crusher shafts and are pressed against said crusher shafts from the opposite sides of said vertical plane to balance the force of the powder and particles on said crusher shafts, the powder and particles in said casting being successively acted on by said crusher shafts and by said discharge conveyor and are discharged by said discharge conveyor to the outside of said casing.

2. An apparatus as claimed in claim 1 in which said casing has a box-like shape with a rectangular horizontal cross-section.

3. An apparatus as claimed in claim 1 in which said crusher shafts have claws on the circumferential surface thereof, means said drive means having a contrarotating starter, said contrarotating starter having a timer means for causing, at the time of starting of said driving means, said crusher shafts to be contrarotated for a short time and then normally rotated.

4. An apparatus as claimed in claim 3 in which said drive means is a three phase electric motor, and said timer means is a timer, and said contrarotating starter has a two phase changeover switch controlled by said said timer for changing over the phases after a period of time controlled by the timer to cause said electric motor to change from contrarotating operation to normal rotation.

5. An apparatus as claimed in claim 3 in which said drive means comprises an electric motor and said timer means comprises two timers, one timer being connected to said electric motor for controlling the time for which the electric motor is contrarotated at the start of operation, and the other timer being connected to said electric motor for controlling the time for which said electric motor is supplied with current for normal rotation.

6. An apparatus as claimed in claim 1 in which said discharge conveyor has a drive motor connected thereto for driving said discharge conveyor, a load detector connected to said drive motor for detecting the load on said drive motor, and a control member connected between said load detector and said crusher shafts for controlling the operation of said crusher shafts in response to the output of said load detector for causing said crusher shafts to be stopped when the load is above the set value.

7. An apparatus as claimed in claim 6 in which said drive motor for driving said discharge conveyor is an electric motor, and said load detector is an electric current detector for detecting the electric current passing through said electric motor, whereby said crusher shafts are operated only when the electric current passing through said electric motor is below a set value.

8. An apparatus as claimed in claim 6 in which said load detector is a torque detector connected to the output side of said drive motor for driving said discharge conveyor, whereby said crusher shafts are controlled in response to the torque detected.

* * * * *